US007267844B2

(12) United States Patent
Branagan

(10) Patent No.: US 7,267,844 B2
(45) Date of Patent: Sep. 11, 2007

(54) PROPERTIES OF AMORPHOUS/PARTIALLY CRYSTALLINE COATINGS

(75) Inventor: Daniel James Branagan, Idaho Falls, ID (US)

(73) Assignee: The NanoSteel Company, Inc., Providence, RI (US)

( * ) Notice: Subject to any disclaimer, the term of this patent is extended or adjusted under 35 U.S.C. 154(b) by 10 days.

(21) Appl. No.: 10/778,263

(22) Filed: Feb. 13, 2004

(65) Prior Publication Data

US 2004/0253381 A1 Dec. 16, 2004

Related U.S. Application Data

(60) Provisional application No. 60/447,399, filed on Feb. 14, 2003.

(51) Int. Cl.
*B05D 3/02* (2006.01)

(52) U.S. Cl. ..... 427/383.1; 427/380; 427/398.1

(58) Field of Classification Search ..... 427/380, 427/383.1, 398.1

See application file for complete search history.

(56) References Cited

U.S. PATENT DOCUMENTS

| | | | | |
|---|---|---|---|---|
| 4,189,618 | A * | 2/1980 | Bretts et al. | 174/35 MS |
| 5,911,840 | A | 6/1999 | Couderchon et al. | |
| 6,074,713 | A * | 6/2000 | Trotter, Jr. | 428/34.4 |
| 6,258,185 | B1 * | 7/2001 | Branagan et al. | 148/525 |
| 6,767,419 | B1 * | 7/2004 | Branagan | 148/522 |

FOREIGN PATENT DOCUMENTS

| | | |
|---|---|---|
| CN | 1185012 | 6/1998 |

OTHER PUBLICATIONS

Office Action mailed on Feb. 16, 2007 received in corresponding Chinese Application No. 2004800069529, 11 pgs.

Yu JIng et al, "Study of Fe—Si—B Amorphous Alloy in Annealing", Journal of Beijing Steel and Iron Institute, see text portion of Chinese office action dated Feb. 16, 2007, p. 2.

EP Supplementary Search Report dated Feb. 15, 2007 received in corresponding European Patent Application Serial No. 04711249.5 (4 pages).

Vogel, et al., "The Effect of Pre-annealing on the Subsequent Crystallization in the Metallic Glasses Fe-Ni-P-B and Fe-Ni-Cr-P-B using Transmission Electron Microscopy", Materials Science and Engineering, 57 (1983) 171-179 (3 pages).

Akhtar, et al., "Thermal and Mechanical Stability of a Ni55Cr5Nb40 Metallic Glass", Acta metall., vol. 34, No. 7, (1986) 1307-1314 (8 pages).

Collins, et al., "Annealing Effects and Homogeneous Flow in Ni60Nb40 Metallic Glass", Materials Science and Engineering, 61 (1983) 137-147 (11 pages).

Branagan, et al., "Developing extreme hardness (>15 GPa) in iron based nanocomposites", Composites: Part A, 33 (2002) 855-859 (5 pages).

Kappes, et al., "Relaxation, recovery, crystallization, and recrystallization transformations in an iron-based amorphous precursor", Institute of Physics Publishing, Nanotechnology 14 (2993) 1228-1234 (7 pages).

* cited by examiner

*Primary Examiner*—Fred J. Parker
(74) *Attorney, Agent, or Firm*—Grossman Tucker Perreault & Pfleger, PLLC

(57) ABSTRACT

According to the present invention, the kinetic conditions (i.e. temperature and time) related to how metal glass alloys are transformed are manipulated to alter the microstructure and the resulting properties of the subject alloys. Low temperature recovery, relaxation, crystallization, and recrystallization phenomena are used to shift the microstructure of amorphous or partially crystalline coatings in order to tailor and improve their properties for specific applications.

4 Claims, 4 Drawing Sheets

Transmission electron micrographs and select SADP (inset) of the sample heat treated for 100 hours at 500°C (a) 42 kX, (b) 89 kX, and (c) 120kX magnification showing the untwinned $Fe_3B$ phase ( 2-5 μm grains and 20-50 nm subgrains), 20-50 nm α-Fe nanoparticles, and residual amorphous phase.

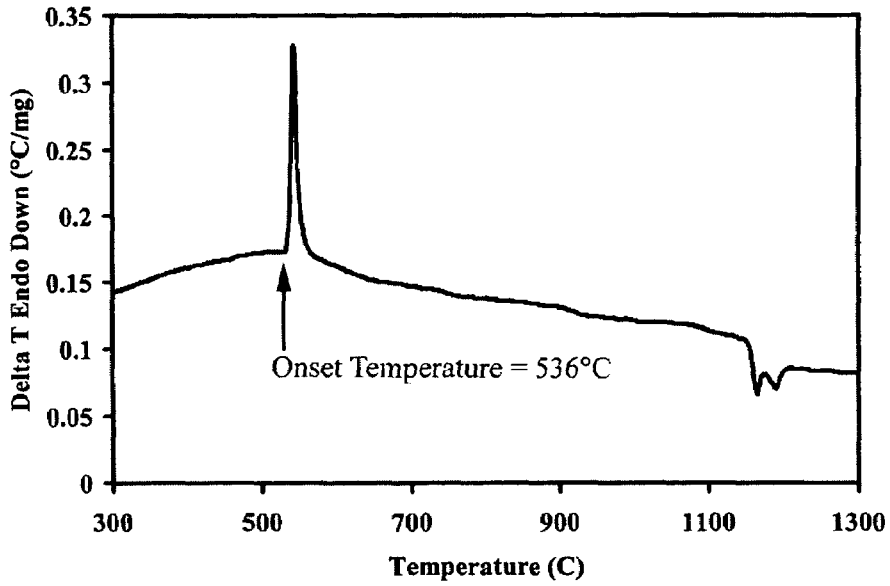

Figure 1 Differential thermal analysis scan of the as-spun $(Fe_{0.8}Co_{0.2})_{79}B_{17}W_2C_2$ alloy. Note that a single crystallization event at an onset temperature of 536°C is identified.

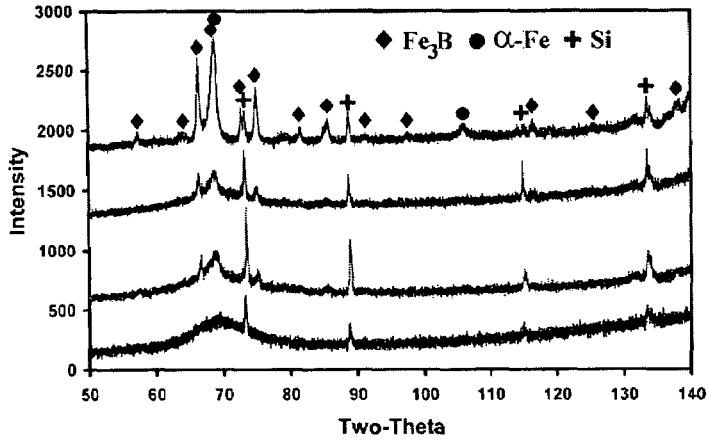

Figure 2 X-ray diffraction patterns of the $(Fe_{0.8}Co_{0.2})_{79}B_{17}W_2C_2$ alloy after (a) 500°, (b) 400°, and (c) 300°C anneals for 100 hours showing the development of the fraction transformed as a function of annealing temperature in comparison to the (d) as-spun material, respectively indicating the plots from top to bottom.

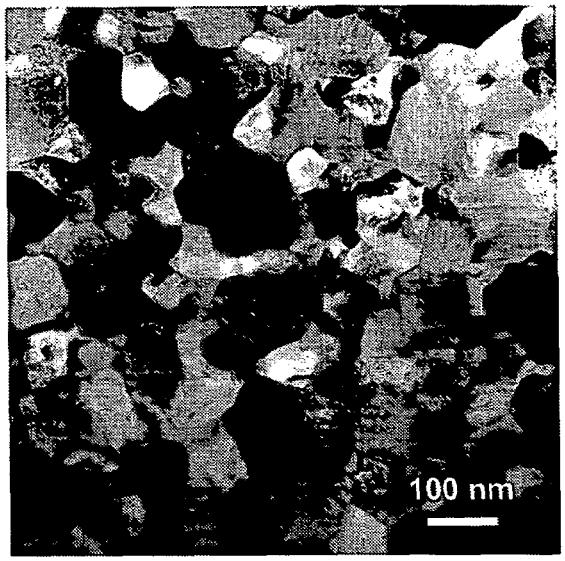

Figure 3 Transmission electron microscopy of the sample heat treated at 700°C for 10 minutes showing the isotropic formation of 100-200 nm $Fe_3B$ (heavily twinned), $Fe_{23}C_6$ (featureless), and α-Fe (mottled) grains.

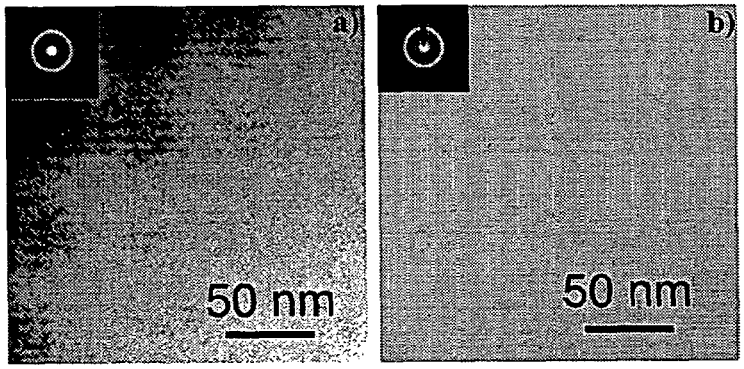

Figure 4 Transmission electron micrographs and SADP (inset) of the samples heat treated for 100 hours at (a) 300° and (b) 400°C. Note the featureless morphology and diffuse ring pattern characteristic of an amorphous material.

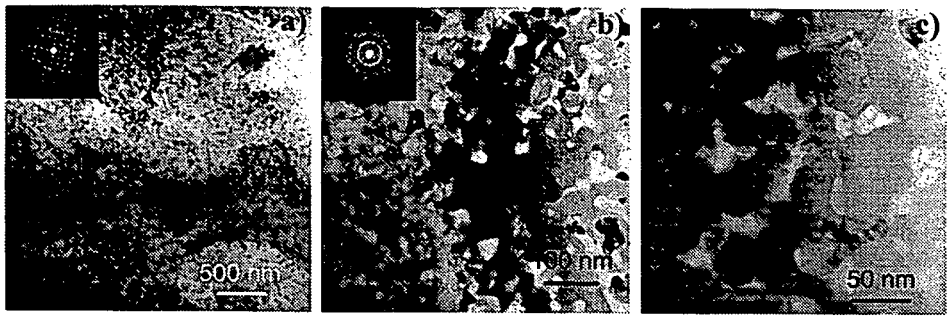

Figure 5 Transmission electron micrographs and select SADP (inset) of the sample heat treated for 100 hours at 500°C (a) 42 kX, (b) 89 kX, and (c) 120kX magnification showing the untwinned $Fe_3B$ phase ( 2-5 μm grains and 20-50 nm subgrains), 20-50 nm α-Fe nanoparticles, and residual amorphous phase.

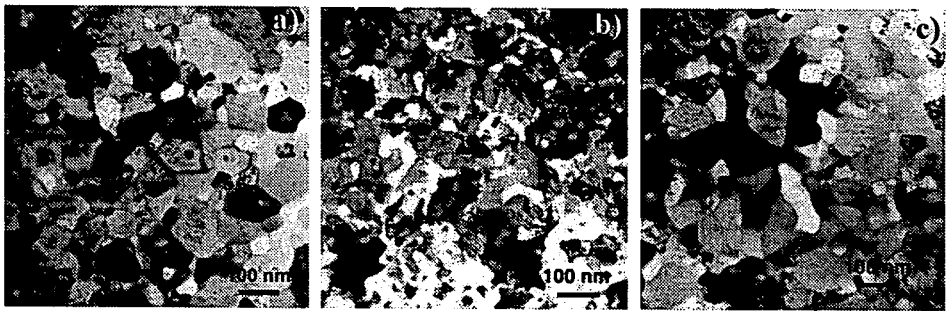

Figure 6 Transmission electron micrographs and SADP (inset) of the sample heat treated for; (a) 300°C for 100 hours and then 700°C for 10 minutes, (b) 400°C for 100 hours and then 700°C for 10 minutes, and (c) 500°C for 100 hours and then 700°C for10 minutes.

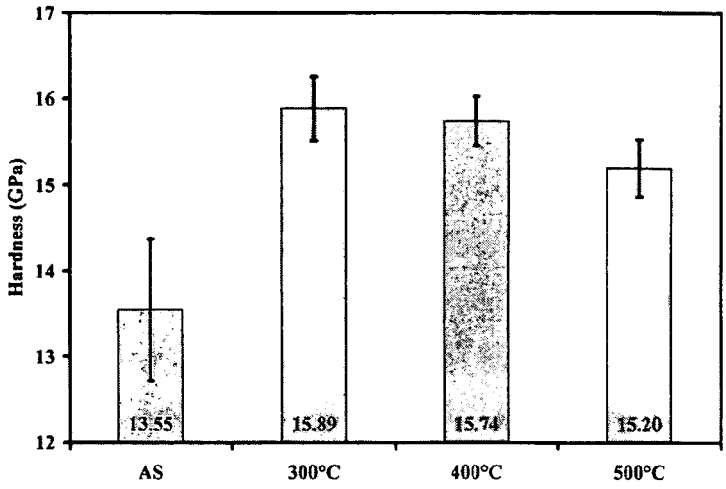
Figure 7 The 700°C for 10 minutes anneal sample (AS) provides a benchmark for examination of the hardness of the material. The remaining samples were heat treated at 300°C for 100 hours and then 700°C for 10 minutes, 400°C for 100 hours and then 700°C for 10 minutes, and 500°C for 100 hours and then 700°C for10 minutes.

PROPERTIES OF AMORPHOUS/PARTIALLY CRYSTALLINE COATINGS

CROSS REFERENCE TO RELATED APPLICATIONS

This application claims priority to U.S. Provisional Application No. 60/447,399 filed Feb. 14, 2003.

FIELD OF THE INVENTION

The present invention generally relates to metallic glasses, and more particularly to a method of improving the properties of primarily glass or partially metallic glass coatings by altering the microstructure thereof.

BACKGROUND

All metallic glasses are metastable materials which will transform into crystalline metal materials given enough activation energy. The kinetics of the transformation of a metallic glass to a crystalline material is governed by both temperature and time. In conventional TTT (Time-Temperature-Transformation) plots, the transformation often exhibits C-curve kinetics. At the peak transformation temperature, the devitrification is extremely rapid but as the temperature is reduced the devitrification occurs at increasingly slower rates, due to generally log-time dependence of the transformation. The peak transformation temperature is generally found using analytical techniques such as differential thermal analysis or differential scanning calorimetry.

If there is a desire is to transform a glass then the glass may be quickly heated to a temperature at or greater than the peak crystallization temperature causing the glass to devitrify into a nanocomposite microstructure. Depending on the composition of the glass/alloy, a specific microstructure may be formed which will yield a specific set of properties. This conventional type of transformation is well known. If a different set of properties is needed, then a new alloy is designed, processed into a glass and then the glass is devitrified.

SUMMARY

A method of forming a metallic glass coating comprising applying a metallic glass coating to a substrate and determining the plot of crystalline transformation v. temperature, i.e. kinetics of glass devitrification, for said metallic glass including identifying a crystallization onset temperature and peak transformation temperature for crystallization. This is followed by heating the metallic glass to a first temperature below said crystallization onset temperature for a first predetermined period of time and cooling the metallic glass to a second temperature.

In one embodiment, a method of forming a metallic glass coating comprises applying a metallic glass coating to a substrate and again determining the plot of crystalline transformation v. temperature, i.e. kinetics of glass devitrification, for said metallic glass including identifying a crystallization onset temperature and peak transformation temperature for crystallization. This is then followed by heating the metallic glass to a first temperature below said crystallization onset temperature for a first predetermined period of time followed by heating the metallic glass to a second temperature above said crystallization onset temperature for a second predetermined period of time and cooling the partially or fully transformed crystalline alloy to a third temperature.

BRIEF DESCRIPTION OF THE DRAWINGS

The invention is described, in part, relative to exemplary embodiments, which description should be read in conjunction with the accompanying figures wherein:

FIG. 1 is a differential thermal analysis scan of the as spun metal glass sample;

FIG. 2 show X-ray diffraction patterns of an exemplary composition after annealing at different temperatures and as spun;

FIG. 3 shows a transmission electron microscopy image of an exemplary sample after heat treating;

FIGS. 4*a* and 4*b* respectively show transmission electron micrographs and selected area diffraction patterns of exemplary compositions after heat treating at different temperatures;

FIGS. 5*a*, 5*b*, and 5*c* respectively show transmission electron micrographs and selected area diffraction patterns at three different magnification levels of an exemplary composition after heat treating;

FIGS. 6*a*, 6*b*, and 6*c* respectively are transmission electron micrographs for and exemplary composition after experiencing three different heat treatment regimens; and FIG. 7 is a chart illustrating the hardness of exemplary compositions after different heat treatment regimens.

DESCRIPTION OF THE INVENTION

As alluded to above, the present invention is directed at altering the microstructure and properties of a metallic glass without requiring compositional changes of the underlying alloy. The kinetic conditions related to the transformation of the metallic glass from a nominally amorphous structure to a nano- or microcrystalline structure may be manipulated to produce low temperature recovery, relaxation, crystallization, and recrystallization, to thereby alter the microstructure and properties of the resulting material. Exemplary manipulation of the kinetic conditions may be accomplished by annealing exposure, such as "one-step anneals" (single temperature annealing exposure) which are carried out at temperatures below the crystallization onset temperature. Alternately, "multi-step anneals" may be conducted in which one or more heat treatments below the crystallization onset temperature are followed by one or more heat treatments above the crystallization onset temperature. Such changes in the thermal conditions of processing alter the microstructure and properties of the resulting devitrified metallic glass. Thus, a wide range of structures and properties can be obtained from a single glass composition.

All metallic glasses are metastable materials and will ultimately transform into their crystalline counterparts. According to the present invention, the kinetic conditions (i.e. temperature and time) related to how metal glasses are transformed (devitrified) may be manipulated to dramatically change the microstructure and the resulting properties of the as-transformed crystalline counterparts. Low temperature recovery, relaxation, crystallization, and recrystallization phenomena may be manipulated to dramatically change the microstructure of amorphous or partially crystalline coatings, thereby tailoring and/or improving the properties for specific applications.

According to the present invention, the kinetic conditions for transforming a metal glass into a nano- or microcrystalline structure may be manipulated by carrying out controlled heating and cooling. In a simplest example, a metallic glass may be put through a simple annealing, heating the metallic glass to a predetermined temperature for a predetermined time. More complex annealing operations may also be used to generate different microstructures in the transformed metallic glass. For example, the metallic glass may be heated to a first temperature for a first period of time, and then further heated to a higher temperature for a second period of time. Additionally, metallic glass material may be put through several cycles of heating to predetermined temperatures and cooling at controlled rates to predetermined temperatures, thereby developing different microstructures.

This invention is especially applicable to the industrial usage of amorphous or partially crystalline coatings. In some exemplary cases, the properties of these coatings were improved dramatically by first heating them up to low temperature, such as 300° C. to 500° C., and then holding them at this temperature range for 100 hours. In other cases, this extended heat treatment time would be impractical since it would add significantly additional cost to the part or in other cases the part which is coated would be too large to be put into a heat treating furnace. However, if the amorphous or partially crystalline coatings are utilized at elevated temperatures, then in-service they may undergo in-situ recovery, relaxation, crystallization, and/or recrystallization. When this occurs their resulting properties may change and in many cases, the coatings may develop superior combinations of properties including strength, hardness, and ductility. This property of a coating which allows it to improve after being subjected to the elevated temperature profiles disclosed herein is unique in the coatings world and represents a key part of this disclosure.

EXAMPLES

An exemplary metallic alloy having the atomic stoichiometry $(Fe_{0.8}Cr_{0.2})_{79}B_{17}W_2C_2$ was processed from high purity constituents (>99.9%) into ribbons by melt-spinning in ⅓ atm helium atmosphere at a tangential wheel velocity of 15 m/s. The exemplary alloy was then heat treated using a conventional annealing process, carried out above the crystallization temperature, to prepare a reference or control sample. Additionally, samples of the alloy were heat treated using a unique "one-step" annealing process according to the present invention that was carried out below the crystallization onset temperature of the alloy. Additionally, samples of the alloy were heat treated using a unique "two-step" annealing process according to the present invention in which the samples were first heat treated at a temperature below the crystallization onset temperature of the alloy, and then subsequently heat treated at a temperature above the crystallization onset temperature of the alloy.

Reference/Control Sample

An as-spun, one-step annealed sample was prepared by annealing a spun specimen at 700° C. for 10 minutes. A plot of crystalline transformation v. temperature, i.e., kinetics of glass devitrification, was determined using differential thermal analysis. This plot is presented as FIG. 1. Using this analysis, the crystallization onset temperature was determined to be 536° C., and the peak crystallization temperature was determined to be 543° C. Additionally, the enthalpy of the glass to crystalline transformation was determined to be −118.7 J/g, and the transformation rate was determined to be 0.018 s. The as-spun, on-step annealed sample was also examined by transmission electron microscopy (TEM) and x-ray diffraction (XRD) to observe the microstructural development of the as-spun sample following a high-temperature heat treatment. The TEM results, presented in FIG. 3, exhibit the formation of an isotropic, 100-200 nm grain structure consisting of three primary phases. These three phases of the as-spun one-step anneal sample were subsequently identified as $Fe_3B$, $Fe_{23}C_6$, and α-Fe using Rietveld analysis of the XRD scan (a known mathematical way of working out the concentrations of the components of a material from its X-ray diffraction pattern). In the TEM illustrated in FIG. 3, the $Fe_{23}C_6$ has a featureless morphology, the α-Fe appears mottled, and the $Fe_3B$ forms a heavily twinned structure during high-temperature annealing. Vickers microhardness measurements were used to provide information on the physical properties produced as a result of this one-step anneal thermal processing step. The results of the microhardness test indicated a hardness of 13.6 GPa. These data provide a foundation for comparison to the structure observed in the 2-step anneals discussed shortly.

One-Step Anneal

Additional exemplary one-step anneal samples were prepared by annealing as-spun samples for 100 hours at one of 300° C., 400° C., and 500° C. As shown in FIG. 2, analysis of XRD scans taken after one-step anneals, in which the as spun samples were annealed at 300° C. and 400° C. for 100 hours, revealed the development of two phases, $Fe_3B$ and α-Fe. As shown in these scans, the volume fraction of crystallization increases with increased low-temperature anneal temperature, reaching a high crystalline fraction during the 500° C., 100 hour one-step anneal. Further investigation using TEM and selected area diffraction patterns (SADP), illustrated in FIGS. 4*a* and 4*b*, revealed that the 300° C. and 400° C. one-step anneal samples display the featureless morphology and diffuse ring pattern characteristic of an amorphous material in the isolated regions imaged. However, the limited area analyzed under TEM only verifies the existence of amorphous material in the sample without confirming or denying the presence of the crystalline phases observed in XRD analysis.

Similarly, XRD, TEM, and SADP were used to study the microstructure of the 500° C. one-step anneal sample. This sample, seen in FIGS. 5*a* through 5*c*, shows the development of a very unusual microstructure. Selected area diffraction patterns verify that the large, 2-5 μm cells seen at 42 k× magnification are indeed $Fe_3B$ grains, as verified by tilting the sample to determine the effect sample orientation had on the diffraction patterns. At increased magnification, these large grains are shown to be composed of aligned 20-50 nm $Fe_3B$ subgrains with roughly equidimensional α-Fe particles dispersed throughout the sample. The spotted ring patterns seen in the SADP are attributed to the randomly aligned α-Fe phase, but the diffuse character may also indicate the presence of a small volume fraction amorphous phase.

Two-Step Anneals

An exemplary two-step annealing process was carried out by further heat-treating the 300° C., 400° C., and 500° C. one-step anneal samples by annealing each sample at 700° C. for 10 minutes. The TEM results of the two-step anneal samples are shown in FIGS. 6*a* through 6*c*. While study into the structure of the 300°, 400°, and 500° C. one-step anneal samples revealed the formation of $Fe_3B$ and α-Fe nanoparticles, the two-step anneals formed $Fe_3B$, α-Fe, and $Fe_{23}C_6$ domains having micro-structural features similar to those observed in the as-spun 1-step anneal sample. However, the 2-step anneal samples also include 20-50 nm α-Fe nanoparticles similar to those seen in the 300°, 400°, and 500° C. one-step anneals. Of note is the distribution of these nanoparticles. They are not relegated to interfacial boundaries, but are also found within the matrix of the $Fe_3B$, $Fe_{23}B_6$, and large α-Fe grains. Referring to FIG. 7, in comparison to the as-spun one-step anneal sample, designated AS in FIG. 7, microhardness measurements show an unequivocal increase in hardness after the two-step annealing process. This augmented hardness abates slowly with increased low-temperature annealing temperature and the resulting increase in the average size of the α-Fe nanoparticles.

A summary of these studies is shown in Table 1 below. In the first row, the structure-property relationships are summarized for a conventional heat treatment (750° C. for 10 minutes) above the crystallization temperature (i.e. 536° C.) and the hardness of the resulting microstructure is given (13.6 GPa). Rows 2-4 summarize the observed metallurgical structures and changes resulting from the "one-step" annealing process according to the present invention as carried out at 300° C., 400° C., and 500° C., respectively, for 100 hours. These temperatures for the one-step annealing process are all below the crystallization temperature of the alloy.

In rows 5, 6, and 7 the observed metallurgical structures and changes that occurred in the alloy, as well as the measured hardness, resulting from the two-step annealing process of the present invention wherein the test samples were respectively heat treated at 300° C. for 100 hours and 750° C. for 10 minutes, 400° C. for 100 hours and 750° C. for 10 minutes, and 500° C. for 100 hours and 750° C. for 10 minutes. In these tests, the first step of the annealing process was carried out below the crystallization temperature, and the second step of the annealing process was carried out at a temperature that was above the crystallization temperature of the alloy. Besides the differences observed in the metallurgical structure, the results also clearly show that the resulting properties (i.e. hardness) are increased to levels greater than 15 GPa.

It should be apparent to those having skill in the art that the various aspects of the disclosed embodiments herein are merely exemplary, and are susceptible to combination and/or to modification beyond the discussed embodiments without departing from the spirit and scope of the invention laid out in the claims.

What is claimed is:

1. A method of forming a metallic glass coating comprising:

applying a metallic glass coating to a substrate;

determining the plot of crystalline transformation v. temperature for said metallic glass including identifying a crystallization onset temperature and peak transformation temperature for crystallization;

heating the metallic glass to a first temperature below said crystallization onset temperature for a first predetermined period of time of 100 hours wherein a volume fraction of a crystalline phase develops; and cooling the metallic glass to a second temperature and wherein in said metallic glass exhibits diffuse ring pattern regions via transmission electron microscopy.

2. The method of claim 1 wherein said metallic glass comprises $(Fe_{0.8}Cr_{0.2})_{79}B_{17}W_2C_2$.

3. A method of forming a metallic glass coating according to claim 1, wherein said first temperature is selected from 100° C. below the crystallization temperature to 1° C. below the crystallization temperature of said metallic glass.

4. A method of forming a metallic glass coating according to claim 1 wherein said first temperature is in the range from about 300° C. to 500° C.

* * * * *